US008407836B1

(12) United States Patent
Sacherman et al.

(10) Patent No.: US 8,407,836 B1
(45) Date of Patent: Apr. 2, 2013

(54) BEDDING ASSEMBLY

(76) Inventors: James Sacherman, Genoa, NV (US); Karen Sacherman, Genoa, NV (US); Andrea Andersson, Genoa, NV (US)

( * ) Notice: Subject to any disclaimer, the term of this patent is extended or adjusted under 35 U.S.C. 154(b) by 0 days.

(21) Appl. No.: 13/287,951

(22) Filed: Nov. 2, 2011

(51) Int. Cl.
*A47G 9/02* (2006.01)

(52) U.S. Cl. ..... 5/497; 5/494; 5/499

(58) Field of Classification Search ..... 5/691, 692, 5/494, 496, 497, 499
See application file for complete search history.

(56) References Cited

U.S. PATENT DOCUMENTS

| | | | | |
|---|---|---|---|---|
| 2,247,667 | A * | 7/1941 | Rosberger | 5/723 |
| 2,627,617 | A * | 2/1953 | Avila | 5/494 |
| 3,530,487 | A * | 9/1970 | Beer | 5/496 |
| 3,832,743 | A * | 9/1974 | Smith | 5/496 |
| 5,042,099 | A * | 8/1991 | Brenner et al. | 5/502 |
| 5,666,680 | A * | 9/1997 | Hackett, Jr. | 5/692 |
| 6,739,002 | B1 * | 5/2004 | Pannu | 5/494 |
| 7,487,560 | B2 * | 2/2009 | McGrath et al. | 5/488 |
| 8,151,386 | B2 * | 4/2012 | Mckee | 5/500 |
| 2010/0251482 | A1 | 10/2010 | MacDonald | |

* cited by examiner

*Primary Examiner* — Michael Trettel
(74) *Attorney, Agent, or Firm* — Haverstock & Owens LLP

(57) ABSTRACT

A zippered fitted bed sheet has a zippered track at least along an edge of the zippered fitted bed sheet and has one or two pockets for receiving mattress corner(s). In some embodiments, a zippered fitted bed sheet is coupled to one or more coverings, such as a sheet, a blanket, comforter, quilt and the like. A bedding assembly includes a zippered fitted bed sheet and a zippered mattress, a zippered mattress pad/topper or a zippered mattress protector, each including a zippered track that corresponds to the zippered track of the zippered fitted bed sheet. The zippered fitted bed sheet is configured to couple with the zippered mattress, the zippered mattress pad, or the zippered mattress protector.

16 Claims, 5 Drawing Sheets

BEDDING ASSEMBLY

FIELD OF THE INVENTION

The present invention relates to an improved bedding assembly, which includes a zippered fitted bed sheet.

BACKGROUND OF THE INVENTION

A prior art fitted bed sheet has a total four pockets, with two pockets in the front and two pockets in the back. Each pocket receives a corner of a mattress. To put the prior art fitted bed sheet on the mattress, the corners of the mattress are lifted up and inserted into the pockets.

However, lifting up the corners, such as the back corners, of the mattress is often difficult because the back corners are usually not easily accessible, especially in a bunk-bed setting. Further, some mattresses, such as memory foam mattresses, are heavy. Fitting a corner of a mattress into a pocket of the prior art fitted bed sheet while lifting up the corner of the mattress is difficult and can easily cause frustration.

SUMMARY OF THE INVENTION

A zippered fitted bed sheet has a zippered track at least along an edge of the zippered fitted bed sheet and has one or two pockets for receiving corner(s) of a mattress. Alternatively, a zippered fitted bed sheet is simply a flat sheet having a zippered track around the perimeter of the flat sheet. In some embodiments, a zippered fitted bed sheet is coupled to one or more coverings, such as a sheet, a blanket, a comforter, a quilt and the like. In some embodiments, the sheet, the blanket, quilt and/or the comforter can be detached from the zippered fitted bed sheet. A bedding assembly includes a zippered fitted bed sheet and a zippered mattress, a zippered mattress pad/topper or a zippered mattress protector, each including a zippered track that corresponds to the zippered track of the zippered fitted bed sheet. The zippered fitted bed sheet is configured to couple with the zippered mattress, the zippered mattress pad, or the zippered mattress protector.

In one aspect, a mattress cover includes a first portion of a zipper along at least an edge of a first side of the mattress cover, and a first pocket at an opposite side of the first side of the mattress cover. The first pocket typically receives a mattress corner. In some embodiments, sidewalls of the mattress sheet that form the first pocket each tapers off to a beginning or an end of the zipper. The first portion of the zipper is adapted to fasten with a second portion of a zipper of mattress or a second portion of a zipper of mattress accessory. The mattress accessory can be a mattress topper or a mattress protector.

In some embodiments, the first portion of the zipper is also along an edge of a first-second side corner and along an edge of a second side of the mattress cover. The first side and the second side are consecutive sides, and the first pocket is opposite the first-second side corner. Alternatively, the first portion of the zipper is also along an edge of a second-third side corner and further along a portion of an edge of a third side of the mattress cover. The second side and the third side are consecutive sides. Alternatively, the first portion of the zipper is also along an edge of a fourth-first side corner and further along a portion of an edge of a fourth side of the mattress cover. The first side and the fourth side are consecutive sides.

In some embodiments, the mattress cover also includes a second pocket at the opposite side of the first side of the mattress cover. Typically, the second pocket configured to receive a mattress corner. In some embodiments, the first portion of the zipper is also along a portion of an edge of a second side of the mattress cover. The first side and the second side are consecutive sides. Alternatively or in addition to, the first portion of the zipper is also along a portion of an edge of a fourth side of the mattress cover, wherein the first side and the fourth side are consecutive sides. In some embodiments, sidewalls of the mattress sheet that form the second pocket each tapers off to a beginning or an end of the zipper.

In some embodiments, the mattress sheet is coupled to at least one bedding accessory. The bedding accessory can be a sheet, a blanket, a quilt, or a comforter.

In another aspect, a bedding assembly includes a mattress and a mattress cover. The mattress typically includes a zippered track along at least a portion of a perimeter of the mattress. The mattress cover includes a zippered track. The zippered track is along at least a portion of the mattress cover. Typically, the zippered track of the mattress corresponds with the zippered track of the mattress cover. The mattress cover also includes at least one pocket. Each of the at least one pocket is configured to receive a corner of the mattress.

In yet another aspect, a bedding assembly includes a mattress topper and a mattress cover. The mattress topper typically includes a top surface and a bottom surface. An example of a mattress topper is a foam pad. The top surface has a zippered track along at least a portion of a perimeter of the top surface, and the bottom surface is adapted to contact a mattress. The mattress cover typically includes a zippered track. The zippered track is along at least a portion of the mattress cover. Typically, the zippered track of the mattress topper corresponds with the zippered track of the mattress cover. The mattress cover also includes at least one pocket. Each of the at least one pocket is configured to receive a corner of the mattress.

In yet another aspect, a bedding assembly includes a mattress protector and a mattress cover. The mattress protector typically includes a surface including a zippered track along at least a portion of a perimeter of the surface, and pockets to receive corners of a mattress. The mattress cover typically includes a zippered track. The zippered track is along at least a portion of the mattress cover. Typically, the zippered track of the mattress protector corresponds with the zippered track of the mattress cover. The mattress cover also includes at least one pocket. Each of the at least one pocket is configured to receive a corner of the mattress.

BRIEF DESCRIPTION OF THE DRAWINGS

Reference will now be made in detail to implementations of the present invention as illustrated in the accompanying drawings. The same reference indicators will be used throughout the drawings and the following detailed description to refer to the same or like parts.

DETAILED DESCRIPTION OF THE INVENTION

In the following description, numerous details are set forth for purposes of explanation. However, one of ordinary skill in the art will realize that the invention may be practiced without the use of these specific details. Thus, the present invention is not intended to be limited to the embodiments shown but is to be accorded the widest scope consistent with the principles and features described herein.

Embodiments of the present invention relate to a bedding assembly which includes a zippered fitted bed sheet. In some embodiments, a zippered fitted bed sheet has a zippered track at least along an edge of the zippered fitted bed sheet and one or two pockets for receiving corner(s) of a mattress. Alternatively, a zippered fitted bed sheet is simply a flat sheet having a zippered track around the perimeter of the flat sheet. Alternatively or in addition to, a zippered fitted bed sheet is coupled to one or more coverings, such as a sheet, a blanket, comforter, a quilt and the like. In some embodiments, the sheet, blanket, quilt and/or comforter can be detached from the zippered fitted bed sheet. The bedding assembly can also include a zippered mattress, a zippered mattress pad/topper or a zippered mattress protector, each including a zippered track that corresponds to the zippered track of the zippered fitted bed sheet. The zippered fitted bed sheet is configured to couple with the zippered mattress, the zippered mattress pad, or the zippered mattress protector.

Figure 1A:
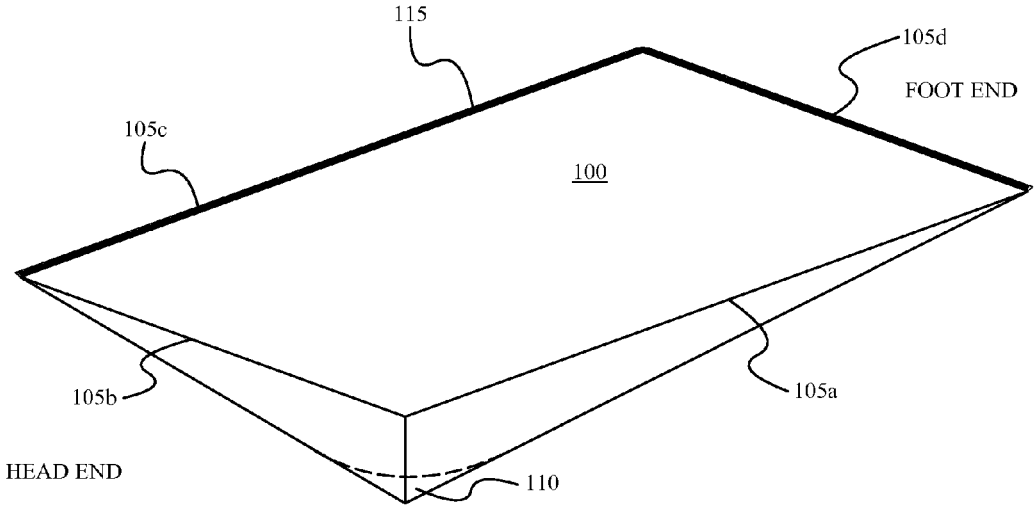
FIGS. 1A-2B illustrate different embodiments of a zippered fitted bed sheet typically used when a side of a bed is positioned against a wall or a sideboard, in accordance with the present invention.
Figure 1B:
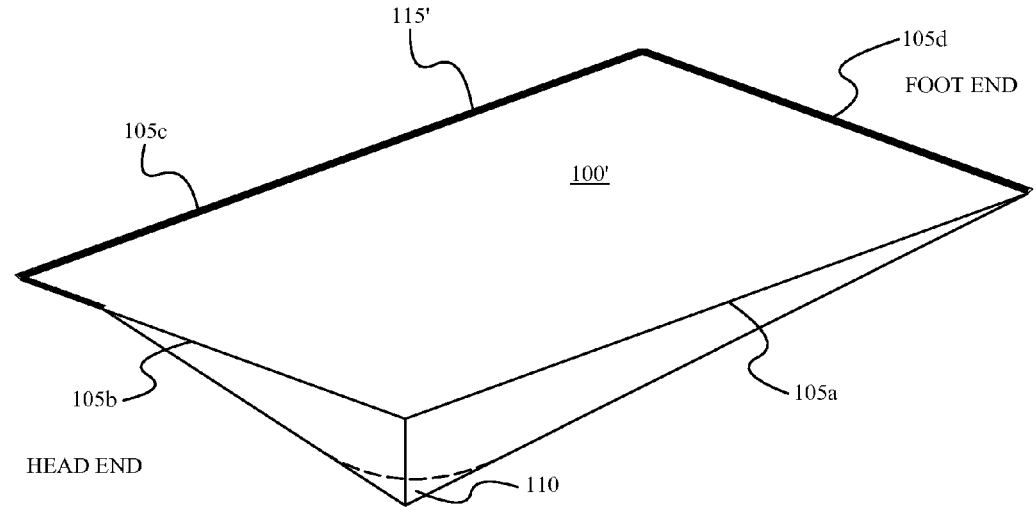
Figure 2A:
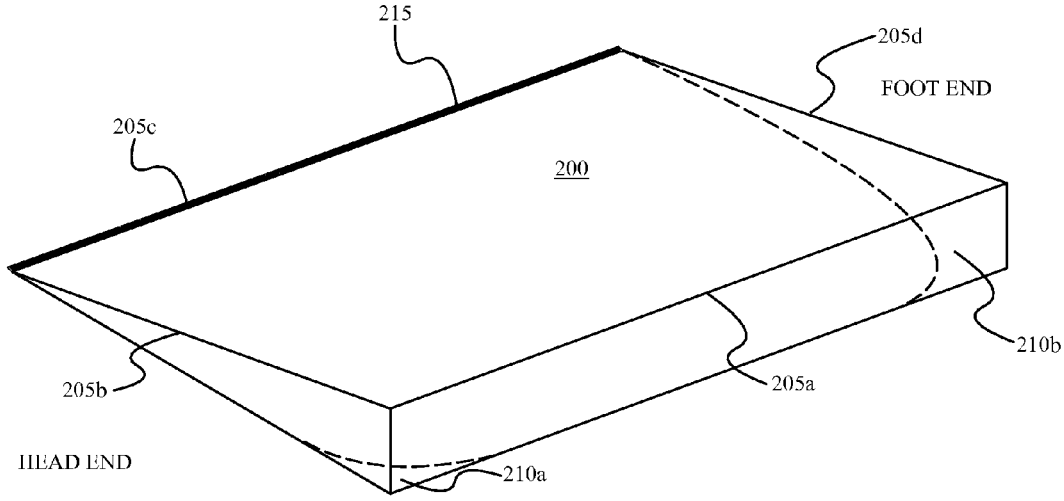
Figure 2B:
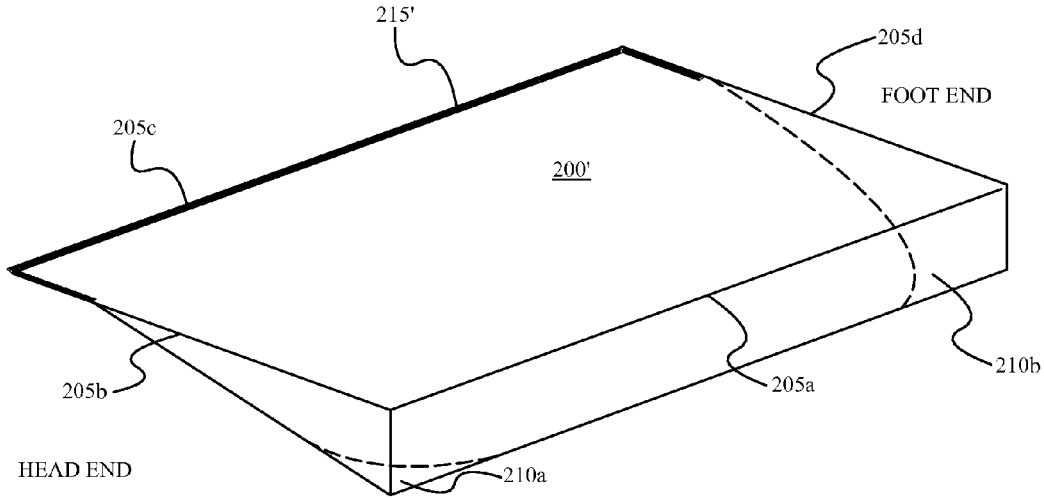

Embodiments of a zippered fitted bed sheet illustrated in FIGS. 1A-2B are typically used in a first scenario where a side of a bed is positioned against a wall or sideboard (e.g., of a daybed). Specifically, FIGS. 1A-1B illustrate different embodiments of a zippered fitted bed sheet having one pocket in accordance with the present invention, and FIGS. 2A-2B illustrate different embodiments of a zippered fitted bed sheet having two pockets in accordance with the present invention. The embodiments illustrated in FIGS. 1A-2B of the present invention advantageously allow a user to leave blankets/quilt tucked into a wall/board side of the bed while the zippered fitted bed sheet is being unzipped.

FIG. 1A illustrates a zippered fitted bed sheet 100 with a pocket 110 at a corner of a head end of the zippered fitted bed sheet 100. The zippered fitted bed sheet 100 also has a zippered track 115. The zippered track 115 is along the entire third edge 105*c* and the entire fourth edge 105*d* of the zippered fitted bed sheet 100. Sidewalls of the zippered fitted bed sheet 100 that form the pocket 110 each tapers off to the ends of the zippered track 115.

FIG. 1B illustrates a zippered fitted bed sheet 100' similarly configured as the zippered fitted bed sheet 100. The zippered fitted bed sheet 100' has a pocket 110 at a corner of a head end of the zippered fitted bed sheet 100' and a zippered track 115'. The zippered track 115' is along the entire third edge 105*c* and the entire fourth edge 105*d* of the zippered fitted bed sheet 100'. The zippered track 115' can also be along a portion of a second edge 105*b*, a portion of a first edge 105*a*, or both. (In FIG. 1B, the zippered track 115' is along a portion of the second edge 105*b* and not along a portion of the first edge 105*a*.) Sidewalls of the zippered fitted bed sheet 100' that form the pocket 110 each tapers off to the ends of the zippered track 115'.

FIG. 2A illustrates a zippered fitted bed sheet 200 with two pockets 210*a*, 210*b* at two corners, one at a head end of the zippered fitted bed sheet 200 and another at a foot end of the zippered fitted bed sheet 200. The zippered fitted bed sheet 200 also has a zippered track 215. The zippered track 215 is along the entire third edge 205*c* of the zippered fitted bed sheet 200. Sidewalls of the zippered fitted bed sheet 200 that form the two pockets 210*a*, 210*b* each tapers off to the ends of the zippered track 215.

FIG. 2B illustrates a zippered fitted bed sheet 200' is similarly configured as the zippered fitted bed sheet 200. The zippered fitted bed sheet 200' has two pockets 210*a*, 210*b* at two corners, one at a head end of the zippered fitted bed sheet 200' and another at a foot end of the zippered fitted bed sheet 200', and a zippered track 215'. The zippered track 215' is along the entire third edge 205*c* of the zippered fitted bed sheet 200'. The zippered track 215' can also be along a portion of a second edge 205*b*, a portion of a fourth edge 205*d*, or both. (In FIG. 2B, the zippered track 215' is along a portion of the second edge 205*b* and a portion of the fourth edge 205*d*.) Sidewalls of the zippered fitted bed sheet 200' that form the two pockets 210*a*, 210*b* each tapers off to the ends of the zippered track 215'.

Figure 3A:
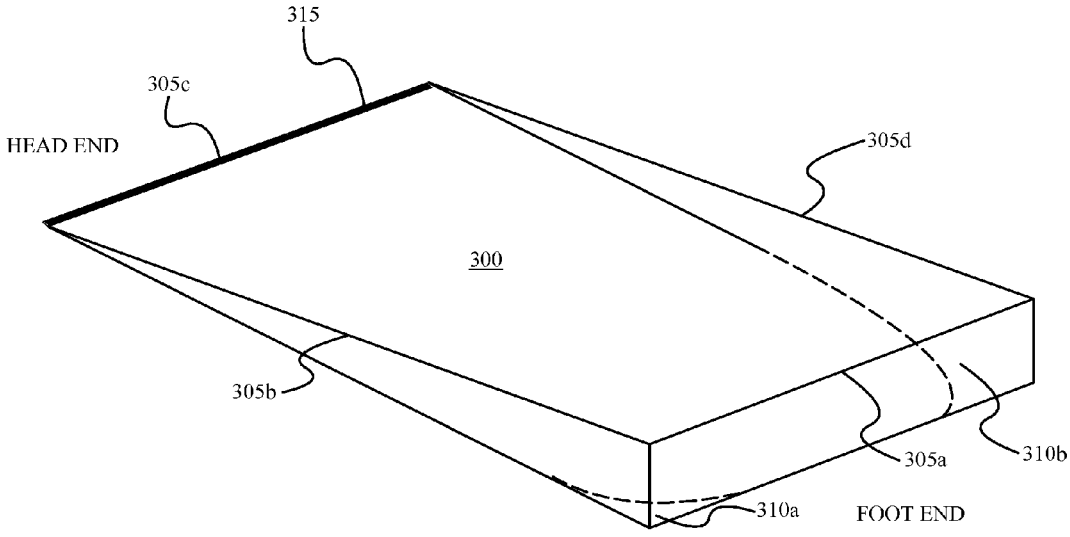
FIGS. 3A-3B illustrate different embodiments of a zippered fitted bed sheet typically used when the top of a bed is positioned against a wall or a headboard, in accordance with the present invention.
Figure 3B:
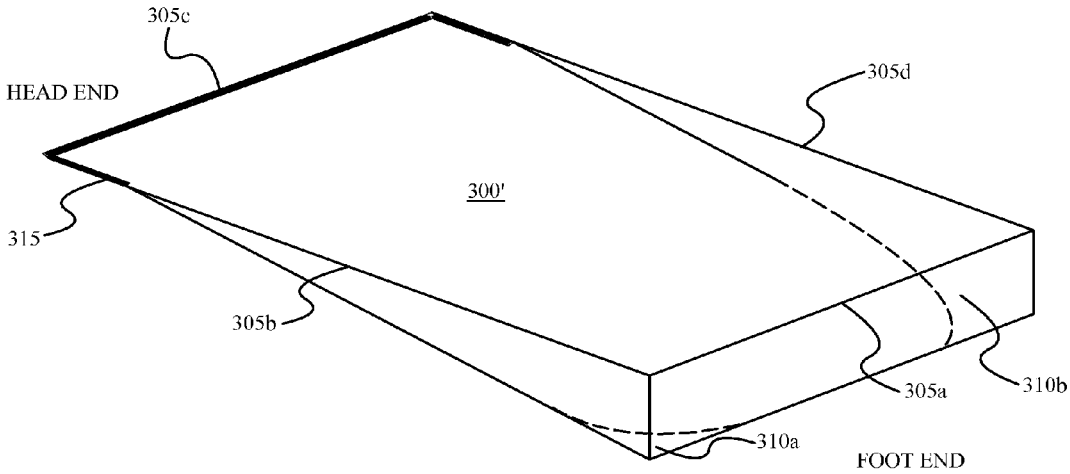

Embodiments of a zippered fitted bed sheet illustrated in FIGS. 3A-3B are typically used in a second scenario where a top of the bed is positioned against a wall or headboard. FIG. 3A illustrates a zippered fitted bed sheet 300 with two pockets 310*a*, 310*b* at two corners at a foot end of the zippered fitted bed sheet 300. The zippered fitted bed sheet 300 also has a zippered track 315. The zippered track 315 is along the entire third edge 305*c* of the zippered fitted bed sheet 300. Sidewalls of the zippered fitted bed sheet 300 that form the two pockets 310*a*, 310*b* each tapers off to the ends of the zippered track 315.

FIG. 3B illustrates a zippered fitted bed sheet 300' is similarly configured as the zippered fitted bed sheet 300. The zippered fitted bed sheet 300' has two pockets 310*a*, 310*b* at two corners at a foot end of the zippered fitted bed sheet 300', and a zippered track 315'. The zippered track 315' is along the entire third edge 305*c* of the zippered fitted bed sheet 300'. The zippered track 315' can also be along a portion of the second edge 305*b*, a portion of a fourth edge 305*d*, or both. (In FIG. 3B, the zippered track 315' is along a portion of the second edge 305*b* and a portion of the fourth edge 305*d*.) Sidewalls of the zippered fitted bed sheet 300' that form the two pockets 310*a*, 310*b* each tapers off to the ends of the zippered track 315'.

Figure 4A:
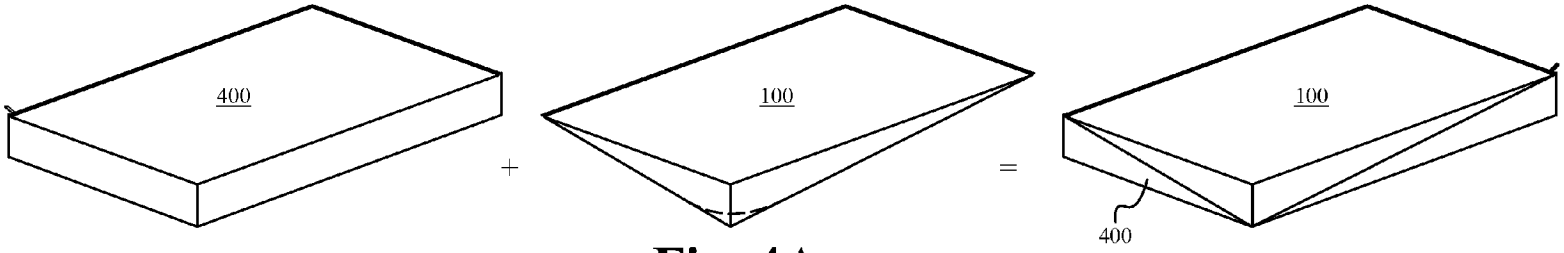
FIGS. 4A-4C illustrates different embodiments of a zippered fitted bed sheet for use with a zippered mattress, in accordance with the present invention.
Figure 4B:
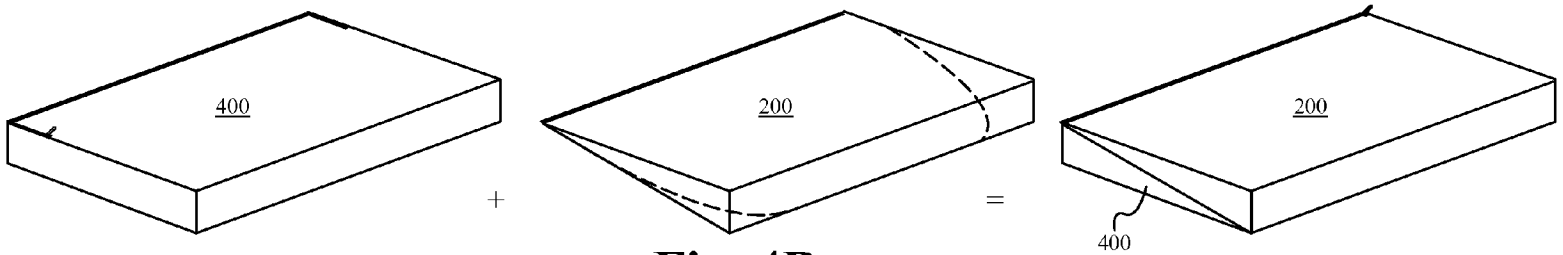
Figure 4C:
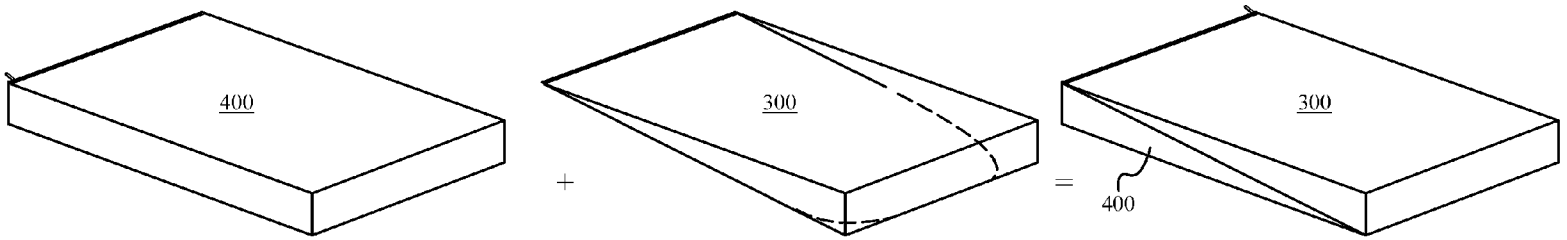

A zippered fitted bed sheet of the present invention is configured to couple with a zippered mattress, a zippered mattress pad/topper, or a zippered mattress protector. Each of the zippered mattress, the zippered mattress pad/topper and the zippered mattress protector includes a zippered track that corresponds to a zippered track of the zippered fitted bed sheet. Typically, when installing the zippered fitted bed sheet, a user first locates a free end of the zipper on the fitted bed sheet and attaches this free end to a corresponding zipper pull on, for example, a zippered mattress. The user then zippers the zippered fitted bed sheet to the zippered mattress. After zippering, the user tucks the pocket(s) of the fitted bed sheet to corresponding corner(s) of the zippered mattress. FIGS. 4A-4C each illustrates a zippered fitted bed sheet 100, 200, 300 coupled to a zippered mattress 400 in accordance with the present invention. When uninstalling, the user simply unzips the zippered fitted bed sheet from the zippered mattress to remove the zippered fitted bed sheet. Although FIGS. 4A-4C show an exemplary zippered mattress, a zippered fitted bed sheet can instead couple with a zippered mattress pad/topper or a zippered mattress protector. Particularly, a first portion of a zipper of a zippered fitted bed sheet is adapted to fasten with a second portion of a zipper of a zippered mattress pad/topper or a zippered protector. A zippered mattress pad and a zippered mattress protector is typically removed less frequently than the zippered fitted bed sheet.

In situations where all corners of a mattress are difficult to access (e.g., bed frame includes headboard and footboard), a zippered fitted bed sheet is a flat sheet without pockets that has a zippered track around all sides of the zippered fitted bed sheet. The zippered fitted bed sheet is configured to couple with a zippered mattress, a zippered mattress pad/topper, or a zippered mattress protector. Typically, when installing the zippered fitted bed sheet, a user first locates a free end of the zipper on the zippered fitted bed sheet and attaches this free end to a corresponding zipper pull on, for example, a zippered mattress. The user then zippers the zippered fitted bed sheet to the zippered mattress. When uninstalling, the user simply unzips the zippered fitted bed sheet from the zippered mattress to remove the zippered fitted bed sheet.

Figure 5A:
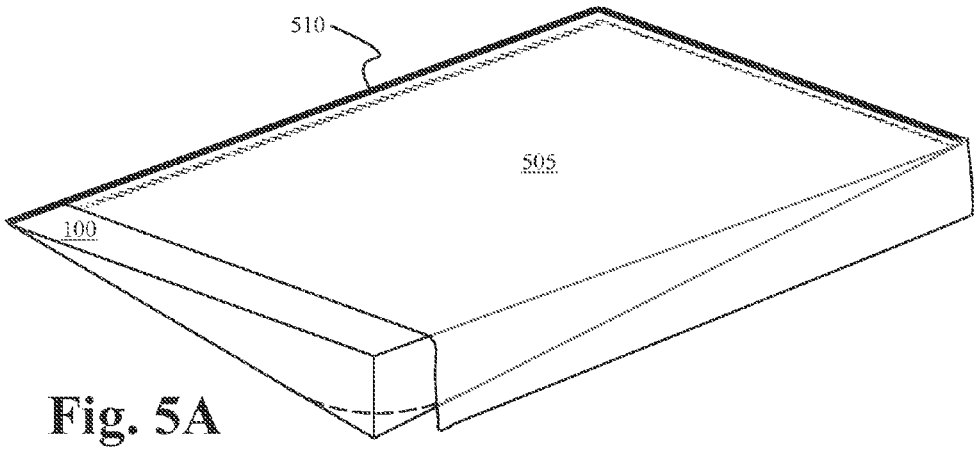
FIGS. 5A-5C illustrate different embodiments of a zippered fitted bed sheet coupled to a sheet, in accordance with the present invention.
Figure 5B:
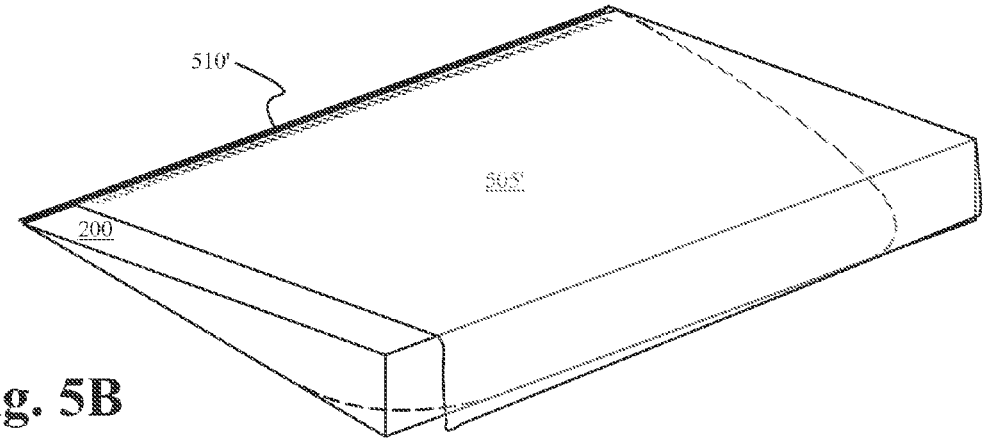
Figure 5C:
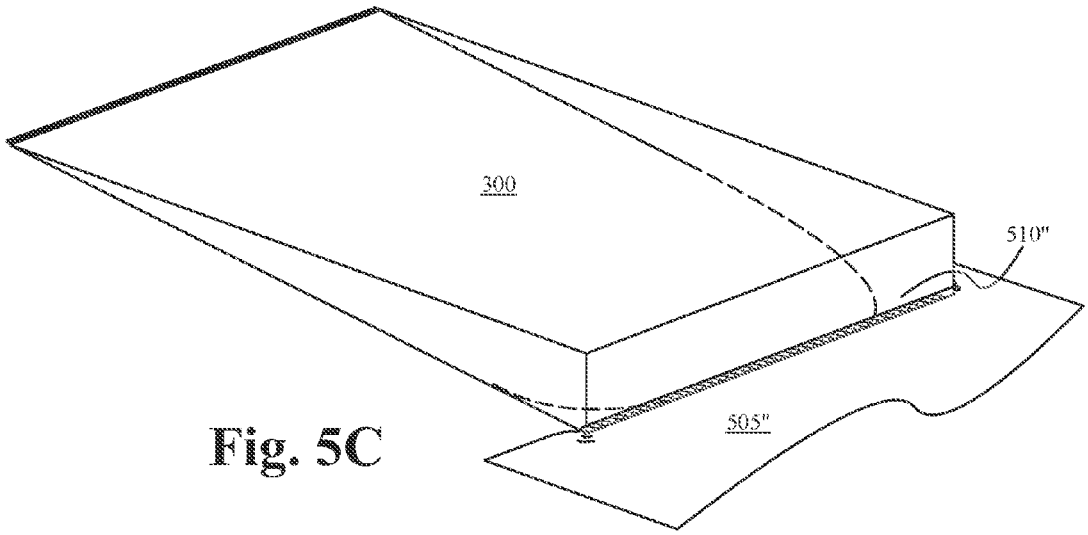

In some embodiments, a zippered fitted bed sheet is detachably coupled to a sheet, as exemplarily illustrated in FIGS. 5A-5C. In FIG. 5A, the zippered fitted bed sheet 100, discussed in FIG. 1A, is coupled to a sheet 505 along an area indicated as 510. In FIG. 5B, the zippered fitted bed sheet 200, as discussed in FIG. 2B, is coupled to a sheet 505' along an area indicated as 510'. In FIG. 5C, the zippered fitted bed sheet 300, as discussed in FIG. 3A, is coupled to a sheet 505" along an area indicated as 510". In some embodiments, the zippered fitted bed sheet is detachably coupled with the sheet using hooks and loops fasteners (e.g., Velcro®), buttons, or a zipper. Alternatively, the zippered fitted bed sheet and the sheet are sewn together. Alternatively, the zippered fitted bed sheet and the sheet are integrally formed using one piece of fabric. It is contemplated that a zippered fitted bed sheet of the present invention can also be or instead be coupled to a blanket, a comforter, or the like.

While the invention has been described with reference to numerous specific details, one of ordinary skill in the art will recognize that the invention can be embodied in other specific forms without departing from the spirit of the invention. Thus, one of ordinary skill in the art will understand that the invention is not to be limited by the foregoing illustrative details, but rather is to be defined by the appended claims.

We claim:

1. A mattress cover comprising:

a. a first portion of a zipper along at least an edge of a first side of the mattress cover, wherein the first portion of the zipper is adapted to fasten with a second portion of a zipper of mattress; and b. a first pocket at an opposite side of the first side of the mattress cover, the first pocket configured to receive a mattress corner.

2. The mattress sheet of claim 1, wherein the first portion of the zipper is also along an edge of a first-second side corner and further along an edge of a second side of the mattress cover, wherein the first side and the second side are consecutive sides, and wherein the first pocket is opposite the first-second side corner.

3. The mattress sheet of claim 2, wherein the first portion of the zipper is also along an edge of a second-third side corner and further along a portion of an edge of a third side of the mattress cover, wherein the second side and the third side are consecutive sides.

4. The mattress sheet of claim 2, wherein the first portion of the zipper is also along an edge of a fourth-first side corner and further along a portion of an edge of a fourth side of the mattress cover, wherein the first side and the fourth side are consecutive sides.

5. The mattress sheet of claim 1, further comprising a second pocket at the opposite side of the first side of the mattress cover, the second pocket configured to receive another mattress corner.

6. The mattress sheet of claim 5, wherein the first portion of the zipper is also along a portion of an edge of a second side of the mattress cover, wherein the first side and the second side are consecutive sides.

7. The mattress sheet of claim 6, wherein the first portion of the zipper is also along a portion of an edge of a fourth side of the mattress cover, wherein the first side and the fourth side are consecutive sides.

8. The mattress sheet of claim 5, wherein sidewalls of the mattress sheet that form the second pocket each tapers off to a beginning or an end of the zipper.

9. The mattress sheet of claim 1, wherein the mattress sheet is coupled to at least one bedding accessory.

10. The mattress sheet of claim 9, wherein the bedding accessory is a sheet, a blanket, a quilt, or a comforter.

11. The mattress sheet of claim 1, wherein sidewalls of the mattress sheet that form the first pocket each tapers off to a beginning or an end of the zipper.

12. A bedding assembly comprising:

a. a mattress including a zippered track along at least a portion of a perimeter of the mattress; and b. a mattress cover including:

1. a zippered track along at least a portion of the mattress cover, wherein the zippered track of the mattress corresponds with the zippered track of the mattress cover; and
2. at least one pocket, wherein each of the at least one pocket is configured to receive a corner of the mattress.

13. A bedding assembly comprising:

a. a mattress topper including:

1. a top surface with a zippered track along at least a portion of a perimeter of the top surface; and
2. a bottom surface, wherein the bottom surface is adapted to contact a mattress; and b. a mattress cover including:

1. a zippered track along at least a portion of the mattress cover, wherein the zippered track of the mattress topper corresponds with the zippered track of the mattress cover; and
2. at least one pocket, wherein each of the at least one pocket is configured to receive a corner of the mattress.

14. The bedding assembly of claim 13, wherein the mattress topper is a foam pad.

15. A bedding assembly comprising:

a. a mattress protector including:

1. a surface including a zippered track along at least a portion of a perimeter of the surface; and
2. pockets to receive corners of a mattress; and b. a mattress cover including:

1. a zippered track along at least a portion of the mattress cover, wherein the zippered track of the mattress protector corresponds with the zippered track of the mattress cover; and
2. at least one pocket, wherein each of the at least one pocket is configured to receive a corner of the mattress.

16. A mattress cover comprising:

a. a first portion of a zipper along at least an edge of a first side of the mattress cover; and b. a first pocket at an opposite side of the first side of the mattress cover, the first pocket configured to receive a mattress corner, wherein sidewalls of the mattress sheet that form the first pocket each tapers off to a beginning or an end of the zipper.

* * * * *